United States Patent [19]

Molenaar et al.

[11] 3,960,564

[45] June 1, 1976

[54] PHYSICAL DEVELOPMENT PROCESS UTILIZING A PHYSICAL DEVELOPER CONTAINING A SPECIFIC REDUCING AGENT, A THIOL COMPOUND

[75] Inventors: Arian Molenaar; Hendrik Jonker, both of Eindhoven, Netherlands

[73] Assignee: U.S. Philips Corporation, New York, N.Y.

[22] Filed: Oct. 24, 1974

[21] Appl. No.: 517,782

Related U.S. Application Data

[62] Division of Ser. No. 369,750, June 13, 1973.

[30] Foreign Application Priority Data

June 21, 1972 Netherlands ..... 7208453

[52] U.S. Cl. ..... 96/48 PD; 96/49; 106/1; 427/304; 427/437

[51] Int. Cl.[2] ..... G03C 5/24

[58] Field of Search ..... 96/66, 66.5, 61, 50 R, 96/48 PD, 49; 106/1; 427/304, 437

[56] References Cited

UNITED STATES PATENTS

| | | | |
|---|---|---|---|
| 3,390,998 | 7/1968 | Cole | 96/66.5 |
| 3,719,490 | 3/1973 | Yudelson et al. | 96/48 PD |

FOREIGN PATENTS OR APPLICATIONS

| | | | |
|---|---|---|---|
| 806,116 | 2/1969 | Canada | 96/48 PD |
| 1,092,607 | 11/1967 | United Kingdom | 96/48 PD |

*Primary Examiner*—Won H. Louie, Jr.
*Attorney, Agent, or Firm*—Frank R. Trifari; Norman N. Spain

[57] ABSTRACT

A solution for the selective electroless deposition of silver comprising as essential constituents silver salt, ammonium hydroxide and a reducer chosen from tartrate, formaldehyde or hydrazine and an organic compound having one or more cyclic or polar aliphatic groups on the one hand and an SH-group on the other hand.

2 Claims, No Drawings

PHYSICAL DEVELOPMENT PROCESS UTILIZING A PHYSICAL DEVELOPER CONTAINING A SPECIFIC REDUCING AGENT, A THIOL COMPOUND

This is a division of application Ser. No. 369,750, filed June 13, 1973.

The present invention relates to aqueous silver-plating solutions for the selective electroless deposition of silver metal.

The so-called silver-plating solutions which are used for making mirrors and for superficially silver-plating of plastics are known. These solutions comprise silver ions which are complex bound by ammonium hydroxide and use a salt of tartaric acid, formaldehyde or hydrazine as reducers. Simultaneously with the desired silver deposition on the surface provided with metal nuclei in such a silver-plating liquid reduction of silver ions in solution takes place. This simultaneous deposition of silver on nuclei and in a solution is presumably caused by the fact that this silver-plating soltuion is not autocatalytically active, in other words, the reduction-oxidation reaction on a silver surface does not proceed catalytically. Physical development with such solutions would therefore be impossible. In contrast to silver-plating solutions physical silver developers in which N-methylaminophenolsulphate ("metol"), hydroquinone, p-phenylenediamine or inorganic redox-systems such as $Fe^{2+}/Fe^{3+}$ and $Ti^{3+}/Ti^{4+}$ are used as reducers yield a selective, autocatalytic silver deposition on the surface of metal nuclei.

Physical developers may be stabilised according to the method known from UK Pat. Spec. No. 936,609 by addition of ionic surface-active materials. Such an addition shields the nuclei which are spontaneously formed in a physical developer in the solution, in that way that these nuclei cannot grow any further. As a result the lifetime of the physical developers may be increased considerably. An improved stabilising action for alkaline physical developers is obtained by the addition of an anti-fogging agent with an ionic surface-active material as described in U.S. Pat. No. 3,390,998. The stabilised physical developers have, however, the drawback that they show little or no suitability for the manufacture of conducting metal patterns in those cases where metal nuclei must be intensified on or at the surface of a carrier layer. The rate of deposition of the intensification becomes zero after some time or, as happens in many cases, deposition is not effected at all.

The invention provides such a modification of chemical silver-plating solutions with tartrate, formaldehyde or hydrazine as reducing agents that they are made suitable for the selective deposition of silver on metal nuclei layers and as physical silver developers.

According to the invention an aqueous electroless silver-plating solution for the selective deposition of silver metal comprising as essential constituents a silver salt, ammonium hydroxide as a complexing compound for the silver ions and a reducing agent chosen from a soluble tartrate, formaldehyde or hydrazine is characterized in that it additionally comprises an organic compound consisting on the one hand of one or more cyclic or polar aliphatic groups and on the other hand of at least one SH-group in a concentration of between $10^{-7}$ and $10^{-2}$ mol/liter. Among compounds that may be employed are those of this type disclosed in the above-mentioned U.S. Pat. No. 3,390,998, particularly the compounds containing an —SH group and disclosed in column 5, line 45 to column 6, line 25.

It is advantageous to add to the silver-plating solution one or more surface-active compound so that the period of time when the selective intensification by means of the bath according to the invention can be used is considerably extended.

It is assumed that these surface-active materials have a solubilizing action relative to the compounds comprising the —SH groups.

The active —SH containing compounds are limited to those which comprise at least one cyclic or polar aliphatic group. Alkylthioles are partly inactive and in so far as they are active they are less attractive due to their unbearable stench and/or their low boiling point.

Although silver-plating solutions according to the invention are active with hydrazine or formaldehyde as reducing agents, solutions with a soluble tartrate are by far to be preferred.

Since formaldehyde is a strong reducing agent the bath must contain a large excess of ammonium hydroxide. Formaline reacts with ammonium hydroxide and as a result formaline must be regularly supplemented.

A silver-plating solution having very good properties comprises a soluble tartrate as a reducing agent and as a further addition phenylmercaptotetrazol in a concentration of between $5 \times 10^{-6}$ and $200 \times 10^{-6}$ mol/liter.

When using the solutions according to the invention as physical developers, that is to say, for obtaining photographic images or patterns located underneath the surface of the carrier, or those which are mainly located on the surface and exhibit electric conductivity it is advantageous to rinse the carrier in a solution of ammonium hydroxide or a soluble pyrophosphate after formation of nuclei but before intensification so as to avoid fog-formation.

This fog is to be ascribed to the fact that metal ions of the nuclei forming bath remain adsorbed on the carrier and upon contact with the metal-plating solution are reduced to metal by the reducing agent present therein.

The silver-plating solutions according to the invention may be used for making silver mirrors and for silver-plating synthetic materials for which the improved bath stability is advantageous. The most important field is their use as physical developers in which the noble metal nuclei or the mercury or amalgam nuclei can be intensified to the desired density or conductivity. These may be produced by exposure of a photo-sensitive semiconducting oxide and by contact with a solution of a noble metal salt and are obtained while using a photo-sensitive compound whose light reaction product is capable of separating mercury or amalgam nuclei from mercurous ions preferably in the presence of silver ions and using the disproportioning equilibrium. These noble metal nuclei also may be produced while starting from a photo-sensitive compound whose light reaction product is capable of reducing noble metal ions to noble metal. Especially for making conducting silver patterns the silver-plating solutions according to the invention are advantageous as compared with the known physical developers.

Some embodiments will now be described to explain the invention.

EXAMPLE 1.

Superficially saponified cellulose-triacetate foil was rendered photosensitive by soaking in an aqueous solution of:

0.40 mol/l p-methoxybenzenediazosulphonic acid sodium
0.10 mol/l cadmium lactate
0.10 mol/l calcium lactate and lactic acid to pH 4

One piece of the foil was treated after a sensitometer exposure with an aqueous solution of 0.005 mol/l mercurous nitrate
0.01 mol/l silver nitrate and
0.01 mol/l nitric acid.

After rinsing in water the foil was shaken for 15 seconds in a solution of 2.5 mol of ammonium hydroxide in water. Subsequently the nuclei image was intensified for 20 minutes to sufficient density with the aid of the following solution:

75 ml of 1% by weight of ammoniacal silver nitrate solution (obtained by complexing 1% by weight of silver nitrate (0.059 mol/l) exactly (0.118 mol/l) with concentrated ammonium hydroxide solution).
25 ml of 1% by weight of potassium sodium tartrate
1 ml of 0.02% by weight of phenylmercaptotetrazol (dissolved in diluted ammonium hydroxide) ($2.10^{-4}$% by weight $\approx 10^{-5}$ mol/l).

After developing, rinsing and fixation took place with 0.10 mol/l of sodiumthiosulfate solution and finally rinsing took place once more in running tap water.

A second piece of foil was exposed behind a line negative and treated in a corresponding manner as the first foil but the formation of the nuclei image was performed with an aqueous solution of 0.075 mol/l mercurous nitrate
0.01 mol/l silver nitrate and
0.10 mol/l nitric acid.

A satisfactorily conducting nuclei image was deposited. After 3 hours a nucleated strip was again selectively developed until sufficient density.

When no phenylmercaptotetrazol is added to the silver-plating solution silver reduction in a solution is produced within several minutes and silver is also deposited on areas outside the desired image.

EXAMPLE 2.

Nuclei images were made in the same way as in Example 1 on foils which were rendered photo-sensitive. After rinsing in water they were intensified for 20 minutes in silver-plating solutions according to Example 1 to which in addition the following surface-active materials had been added.

Cationic surface-active materials:

a. 0.025 % by weight of Armac 12 D, which is a mixture of approximately 90% of dodecylamineacetate, approximately 9% of tetradecylamineacetate, remainder acetates of higher alkylamines.
b. 0.025 % by weight of Deodorant G 271 (the ethylsulfate of N-ethyl-alkyl morpholine (alkyl = $C_{16}$–$C_{18}$)).

Anionic surface-active materials:

c. 0.025 % by weight of Areskap 100, the Na-salt of butylhydroxydiphenylsulphonate.
d. 0.025 % by weight of Lissapol C, the Na-salt of oleylsulphonate.

Amphoteric surface-active materials:

e. 0.025 % by weight of Triton QS 15, an ethoxylated Na-salt.

Non-ionic surface-active materials:

f. 0.025% by weight of Myrj 51 (polyoxyethylenestearate)
g. 0.025% by weight of Triton X102 (octylphenoxypolyethoxyethanol).

Nuclei image were intensifed to sufficient final density at different instants after composing the silver-plating solutions. Strips were developed during the same time as just after the composition of the solutions with the additions *b* and *e* after 7 hours, with *a*, *f* and *g* after 2 days and with *c* and *d* after 4 days. The gammas (i.e. the slope of the density curve as a function of the exposure time) of the selectivity obtained nuclei images had decreased by less than 20%. Without surface-active material the gamma of the obtained area of density had decreased by more than 20%.

EXAMPLE 3.

Nuclei images obtained in accordance with Example 1 on carrier material were selectively intensified with silver-plating solutions according to said Example in which instead of phenylmercaptotetrazol the following additions were used:

a. $10^{-5}$ % by weight of cysteine,
b. $10^{-5}$ % by weight of thioglycol acid and 0.025 % by weight of Areskap 100,
c. $10^{-2}$ % by weight of mercaptobenzothiazol and 0.25 % by weight of Triton QS 15 (i.e. an ethoxylated Na-salt having approximately 35 othoxy groups and a molecular weight of approximately 2390).

After 2 hours nuclei images were again seletively intensified until sufficient final density.

Instead of an ammonium hydroxide solution as an anti-fogging agent it is alternatively possible to use an 1% by weight sodium pyrophosphate solution.

EXAMPLE 4.

A nuclei image on carrier material obtained in accordance with Example 1 was not treated with an antifogging solution, but was directly intensified to sufficient final density with an aqueous solution consisting of:

50 ml 1% by weight of ammoniacal silver nitrate solution
5 ml of an approximately 11 mol/l ammonium hydroxide solution
1 ml 37 % by weight of formaline
$10^{-3}$ % by weight of phenylmercaptotetrazol and
0.25 % by weight of Triton QS 15.

After 45 minutes 1 ml of formaline was again added and a nuclei image could again be intensified to sufficient final density.

When no phenylmecaptotetrazol was added, silver deposition was effected within several minutes in the solution and at areas in the foil outside the desired image.

EXAMPLE 5.

A lantern slide glass was treated for 2 minutes with a solution consisting of 5 grs of stannous chloride and 10 mls of hydrochloric acid per liter of water. After rinsing the uniform nuclei layer obtained was intensified to a reflecting surface with the aid of the following silver-plating solution:

43 ml 1% by weight of ammoniacal silver nitrate solution
1 ml of an approximately 11 mol/l ammonium hydroxide solution
1 ml 2 % by weight of hydrazine sulphate solution
4 ml 9.2% by weight of phenylmercaptotetrazol and
0.01 mol/l ammonium hydroxide and d
1 ml 25% by weight of Triton QS 15.

After 10 minutes the solution was still completely stable. When no phenylmercaptotetrazol was added, silver metal deposition in the solution was produced within 30 seconds.

EXAMPLE 6.

A quartz plate was roughened with carborundum grains having a diameter of approximately 38$\mu$m. The roughened quartz plate was treated for 30 seconds with a concentrated hydrogen fluoride solution. After rinsing and drying a layer of a negative photoresist based on polyvinylcinnamate commercially available under the name of Shipley AZ 1350 was provided by immersion. The layer was dried for 10 minutes at 70°C. After exposure in accordance with a pattern and development the quartz plate was treated for 2 minutes with an aqueous solution of 5 grs. of stannous chloride and 10 mls. of hydrochloric acid per liter. After rinsing silver-plating was effected for 40 minutes at 31°C in the following solution:

75 ml 6 gr. silver nitrate/600 ml water + ammonium hydroxide added until the solution appears clear
25 ml 2% by weight of potassium sodium tartrate
1 ml 25% by weight of Triton QS 15,
2 ml 0.02 % by weight of phenylmercaptotetrazol.

After removing the photoresist with methylethylketone a satisfactorily conducting and solderable silver layer was deposited in accordance with the pattern and had a layer thickness of 0.5 $\mu$m. When development took place 3 times as long, the deposited quantity of silver was likewise 3 times as large.

EXAMPLE 7.

A plate of glass fibre-intensified epoxy resin was provided with an adhesive consisting of a homegeneous dispersion of $TiO_2$ particles in a solution of a combination of 1 part by weight of a rubber-like butadiene acrylonitrilecopolymer, 1 part by weight of a thermosetting epoxy resin and 1/20 part by weight of a polyamine hardener in methylethylketone in which the weight ratio between adhesive and $TiO_2$ was 1 : 2. A layer of a negative photoresist was provided on the adhesive in accordance with the previous example. After exposure and development the photoresist was locally removed. The $TiO_2$ adhesive was roughened with a bichromate sulphuric acid solution having the following composition:

100 ml concentrated $H_2SO_4$,
50 g concentrated $H_3PO_4$,
30 g $Na_2Cr_2O_7$. $H_2O$ and
100 ml water.

After treating with a palladium chloride solution exposure took place. The remaining photoresist was removed with acetone and the palladium nuclei image was intensified in a silver-plating solution with $2.10^{-4}$% by weight of phenylmercaptotetrazol and 0.24% by weight of Triton QS 15 in accordance with Example 1. After 10 minutes a satisfactorily selective black image was obtained and after 20 minutes an eminently conducting silver layer was obtained.

What is claimed is:

1. In the method of producing a carrier with a silver coating by first providing physically developable metal nuclei image produced by selective exposure of a photo-sensitive layer on a carrier and then physically developing said metal nuclei image with an aqueous solution of a silver salt an a reducing agent therefor, the improvement where after formation of the metal nuclei image the carrier is rinsed with a solution comprising ammonium hydroxide or a soluble pyrophosphate and the carrier is then treated with an electroless silver plating composition comprising an aqueous solution of a silver salt, ammonium hydroxide as a complexing compound for silver ions, a reducing agent selected from the group consisting of soluble tartrates, formaldehyde and hydrazine and in addition an organic compound containing at least one —SH group and at least one cyclic or polar aliphatic group in a concentration of between $10^{-7}$ and $10^{-2}$ mol/liter.

2. A carrier having a surface coated with a silver image as provided by the method of claim 1.

* * * * *